United States Patent [19]

Phillips et al.

[11] Patent Number: 4,976,196

[45] Date of Patent: Dec. 11, 1990

[54] COMPACTION OF ALUMINUM BEVERAGE CANS

[75] Inventors: Wilson C. Phillips, Saskatoon; Anita Germann, Regina; Orville J. Olm, Saskatoon, all of Canada

[73] Assignee: Wita Products Limited, Saskatoon, Canada

[21] Appl. No.: 334,187

[22] Filed: Apr. 6, 1989

[51] Int. Cl.[5] ..... B30B 7/00

[52] U.S. Cl. ..... 100/233; 100/264; 100/291; 100/293; 100/902

[58] Field of Search ..... 100/42, 902, 233, 234, 100/236, 244, 263, 264, 281, 283, 285, 291, 293, 902

[56] References Cited

U.S. PATENT DOCUMENTS

| | | | |
|---|---|---|---|
| 3,732,804 | 5/1973 | Moller | 100/42 |
| 3,766,849 | 10/1973 | Maron | 100/233 X |
| 3,980,015 | 9/1976 | Woodard | 100/233 |
| 3,988,978 | 11/1976 | Flick | 100/902 X |
| 4,291,618 | 9/1981 | Heiser et al. | 100/283 X |
| 4,403,545 | 9/1983 | Toburen et al. | 100/902 X |

FOREIGN PATENT DOCUMENTS

| | | | |
|---|---|---|---|
| 58-93597 | 6/1983 | Japan | 100/902 |

*Primary Examiner*—Harvey C. Hornsby
*Assistant Examiner*—Stephen F. Gerrity
*Attorney, Agent, or Firm*—Adrian D. Battison; Stanley G. Ade; Murray E. Thrift

[57] ABSTRACT

A simple household type can crusher to be used on aluminum beverage cans causes a crushing action in which the ends of the can are rotated so that they lie flat on an upper surface of the crushed can with the peripheral wall of the can remaining in tact on one side of the crushed can for inspection of the printed material so that the origin of the can can be determined. The can crusher includes a pair of handles which, when rotated to the vertical position brings two rods into contact with the upper surface of the can while it lies horizontal thereby creasing the can and causing the ends of the can to rotate towards the creased portion. When the handles are rotated to the horizontal position this brings two paddles into contact with the partially rotated ends of the can and, with minimal pressure on the handles, the can is compressed into a readily salvagable shape of four inches by six inches. The handles are then rotated to the original clear position which allows easy removal of the compacted can.

19 Claims, 4 Drawing Sheets

COMPACTION OF ALUMINUM BEVERAGE CANS

BACKGROUND OF THE INVENTION

This invention relates to an apparatus and method for the crushing or compaction of aluminum beverage cans.

It is well known that the crushing of beverage cans is highly desirable to assist in recycling for environmental purposes. Various designs of can crushers have been put forward as patent proposals but very few if any are commercially available as a simple, inexpensive device which can be suitable for household use. In addition most proposed designs of can crushers arrange to crush the cans in a lengthwise direction so as to form a disk or patty shape with the ends substantially intact and the peripheral wall of the can crushed into a concertina form. In this condition all lettering and commercial information on the can is obliterated so that it is no longer possible to determine what type of can is involved. This is a problem in many instances since not all cans carry a refundable deposit or the deposit payable may differ from can to can.

SUMMARY OF THE INVENTION

It is a first object of the present invention, therefore, to provide a can crusher which is of a simple and economic construction so that it can be sold in a price range that is suitable for use in the average household. In this way home residents can easily and quickly crush aluminum beverage cans to reduce their bulk for storage and permitting easy transportation of the cans to a recycling collection centre for cash refunds of deposits or for payment of cash sums for the scrap value of the cans.

It is a further object of the present invention to provide a crushing or compaction device which crushes the cans flat in a lengthwise configuration which leaves one side of the peripheral wall of the can substantially intact but flattened thus allowing for visual determination of the original type of the can involved.

According to the first aspect of the invention, therefore, there is provided an apparatus for crushing a can which includes a cylindrical peripheral wall having a longitudinal axis and a pair of ends at right angles to the axis, the apparatus comprising a base member defining a surface against which the can is laid and is crushed, means defining an area on the base member for receiving the can with the axis of the can parallel to the surface, the ends of the can standing substantially outwardly at right angles from the surface, one side of the can being adjacent the surfaCe and an opposed side of the can being remote from the surface, first crushing means arranged to engage the peripheral wall at said opposed side of the Can and to press the opposed side of the peripheral wall toward said one side such that the ends tend to partly fold inwardly toward the first crushing means, and second means arranged to engage the ends of the can in the partly folded condition thereof and to compress the ends towards said surface of the base member.

According to a second aspect of the invention there is provided a method for crushing a can which includes a cylindrical peripheral wall having a longitudinal axis and a pair of ends at right angles to the axis, the method comprising providing a surface against which the can is laid and is crushed, positioning the can on the surface with the axis of the can parallel to the surface, the ends of the can standing substantially outwardly at right angles from the surface, one side of the can being adjacent the surface and an opposed side of the can being remote from the surface, crushing the peripheral wall of the can at said opposed side of the can to press the opposed side of the peripheral wall toward said one side such that the ends tend to partly fold inwardly in a first crushing action, engaging action, engaging the ends of the can in the partly folded condition thereof and compressing the ends towards said surface in a second crushing action to complete crushing of the can of the base member.

The present invention therefore provides a hand-operated can crusher utilizing the tensile strength of the side of the can to partly rotate the ends of the can toward the first crushing element. The ends of the can are then compacted by means of paddles which, through high mechanical advantage, allows the compaction with a minimum amount of force exerted by the user. The ends are thus folded inwardly so they lie on an upper side of the crushed body with the whole of the other side of the crushed body being exposed. The original printed material on the can remains available for inspection thus identifying the type of can involved.

The lever action used to operate the first and second crushing elements enables a device to be used with very little force. This ease of action provided by the crusher enables the device to be used by 3 year olds to 80 year olds and provide an enjoyment or entertainment value in the crushing of the cans which will enhance the recovery and recycling of cans which now litter private and public property.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
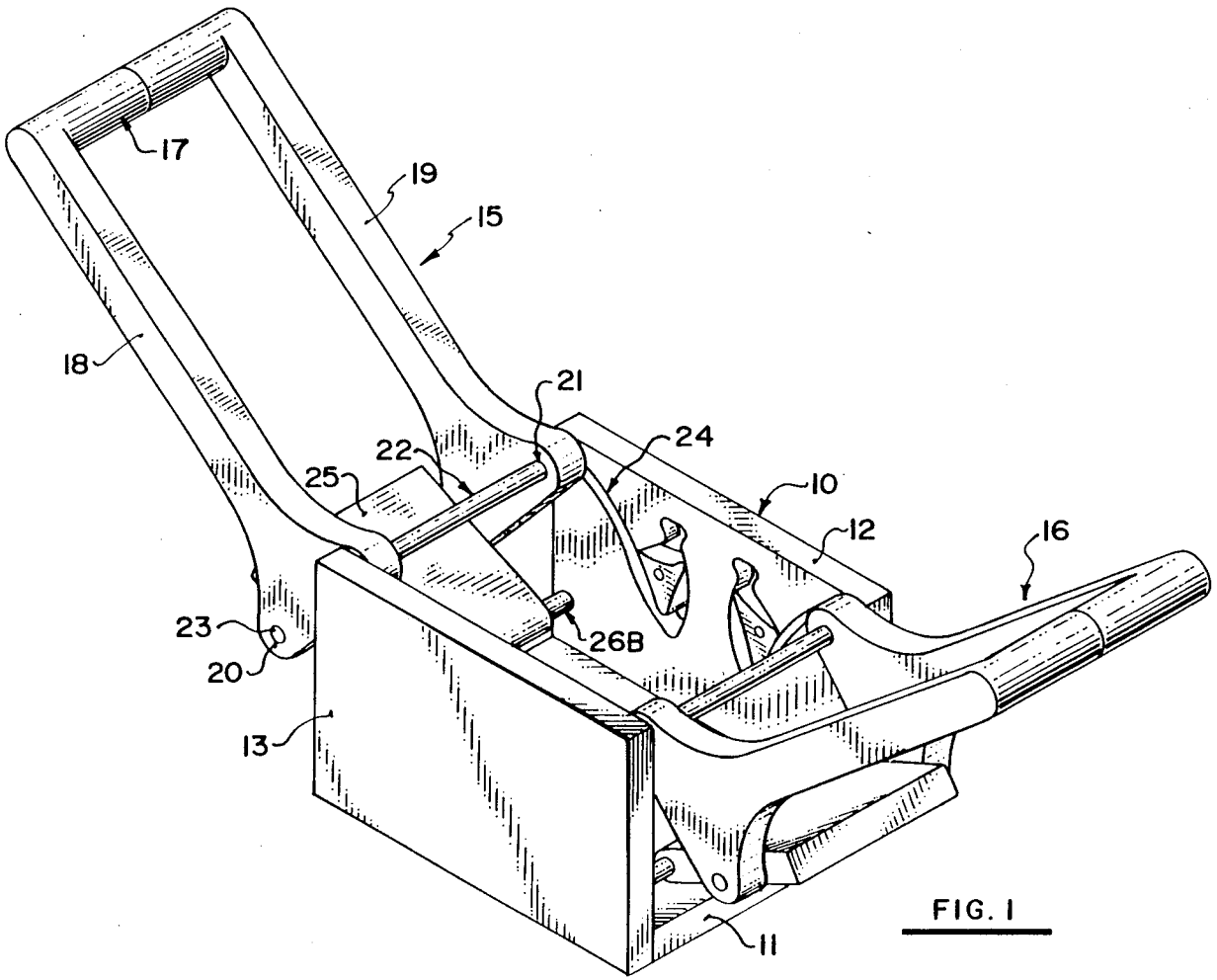
FIG. 1 is an isometric view of a can crusher according to the invention.

The can crusher according to the invention comprises a base member 10 having a flat horizontal base wall 11 and a pair of upstanding sides 12 and 13. The base member thus defines a channel which has a width and a length sufficient to receive a can. The can has a peripheral wall which is cylindrical and surrounds a longitudinal axis of the can together with end walls which lie at right angles to the axis. The shape of the base member is such that the can can lie on the bottom wall 11 between the sides 12 and 13 with one side of the peripheral wall in Contact with the base wall 11 and the ends of the can standing vertically upwardly from the base wall 11 and retained within the open ends of the base member at right angles to the sides.

The base member carries two lever mechanisms indicated respectively at 15 and 16 each of which includes crushing elements for acting on an adjacent end of the can. The lever mechanisms 15 and 16 are identical and hence only one of these will be described in detail.

The lever mechanism 15 comprises a handle 17 and a pair of side frames 18 and 1 9 which are formed integrally to define a yolk with a width slightly less than the width of the side walls 12 and 13 so the base of the side frames of the handles can be received inside the side walls 12 and 13. The handle 17 provides a manually graspable element which is cylindrical in shape allowing the hand of the user to rotate the lever mechanism about its lower end.

Each side frame 18, 19 is generally T-shaped in side elevation defining the handle at the base of the T-shape and providing holes 20 and 21 adjacent the ends of the cross bar of the T-shape. A rod 22 is inserted into the holes 21 of the sides 18 and 19 so as to span the space therebetween and to project outwardly beyond the outer surface of the respective side as indicated at 22A to form a pin for cooperation with a cam-track 24 on the inner surface of the side wall 12 and 13. Although only the cam-tracks 24 on the side wall 12 are visible, it will be appreciated that similar cam-tracks are provided on the inner surface of the side wall 13 for cooperation with the pin 22A visible in FIG. 2. The rod 22 is fixed within the holes 21 so that it maintains the required position and stabilizes the base of the lever structure 15 to maintain the sides 18 and 19 parallel.

A similar rod 23 extends across the space between the sides 18 and 19 and is fixed within the holes 20.

rectangular plate member or paddle 25 has parallel upper and lower surfaces both of which are rectangular in plan view. An inner end of the plate member 25 has a transverse bore receiving a rod 26 which projects outwardly to each side of the plate member 25 to define pins 26A and 26B which project into blind openings in the side wall 12 and 13 respectively. For additional support of the rod 26, a central boss 27 is provided mounted upon the base wall 11 and upstanding therefrom to provide a bore or bearing surface for carrying a centre portion of the rod 26. The boss 27 is accommodated within the plate member 25 by a cut-out 28 which allows the plate member to pivot around an axis defined by the rod 26. The spacing of the boss 27 of the lever device 15 from the boss 27 of the lever device 16 is such that the can can just rest in that area with its end walls adjacent the respective one of the bosses 27.

A slot shaped opening 29 is provided through the plate member 25 from a position adjacent the rod 26 to a position closely adjacent the outer edge of the plate member 25. The slot shaped opening 29 receives the pin 23 of the lever mechanism to extend through the slot. In this way the lever arms 18 and 19 and the plate member 25 are coupled for cooperating movement with the movement defined by the pivotal action of the plate member around the axis of the rod 26 and the cooperation the rod 22 with the cam-tracks 24.

Figure 4:
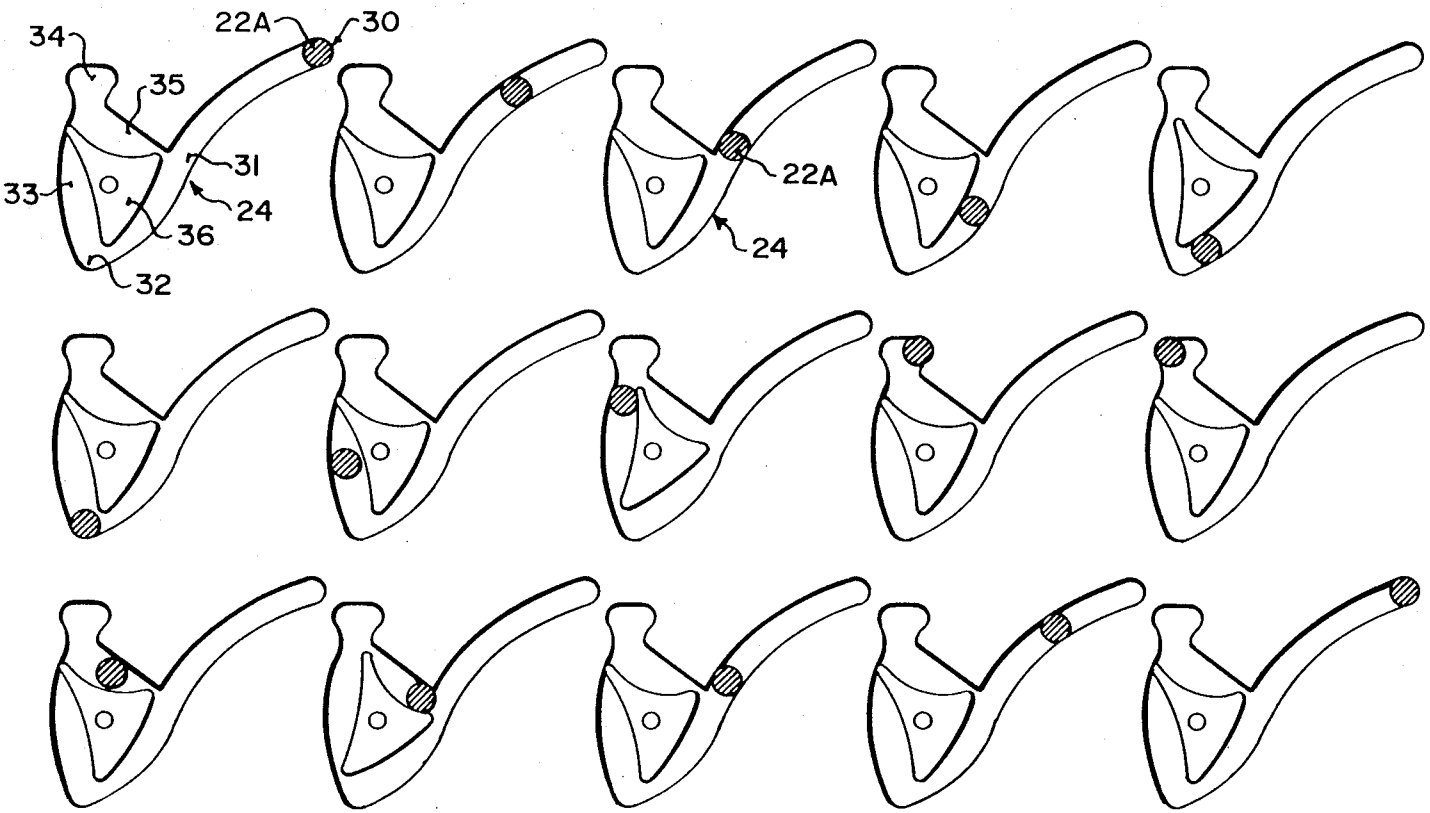
FIG. 4 is a series of sequential views of the Cam-track by which operation of the levers and associated crushing elements is guided.

The shape of the cam-track 24 is in most detail in FIG. 4. The cam-track includes home position 30 with the pin 22A shown in the home in the first of the sequential steps shown in FIG. 4. From that home position, the cam-track includes a first path 31 Which curves downwardly towards a lowermost position 32. A second path of the cam-track is indicated 33 in which the path moves substantially vertically from the lowermost position 32 to an upper position 34 which widened to define two receptacles for the pin 22A. A third path of the cam track is indicated at 35 in which the pin 22A moves downwardly and rearwardly to rejoin the path 31 a position part-way along its length following which the third part follows the path 31 back to the home position 30.

A generally triangular shaped cam control member 36 is provided to separate the recess define-d in the inner surface of the side 12, 13 into the three separate paths of the cam-track and to prevent the pin 22A from reversing in direction so it properly follows the first, second and third paths of the cam-track sequentially. Thus the cam control member 36 is weighted so that it normally pivots to the position shown in the first position of FIG. 4 but is pivoted in a clockwise direction by the movement of the pin 22A as shown in the 5th sequential position of FIG. 4, the 8th position and the 13th position. It will be appreciated that as soon as the pin 22A moves beyond the cam control member, the cam control member moves back into its normal position thus preventing the pin 22A from reversing in direction and ensuring that it follows on to the next path of the cam-track.

Figure 2:
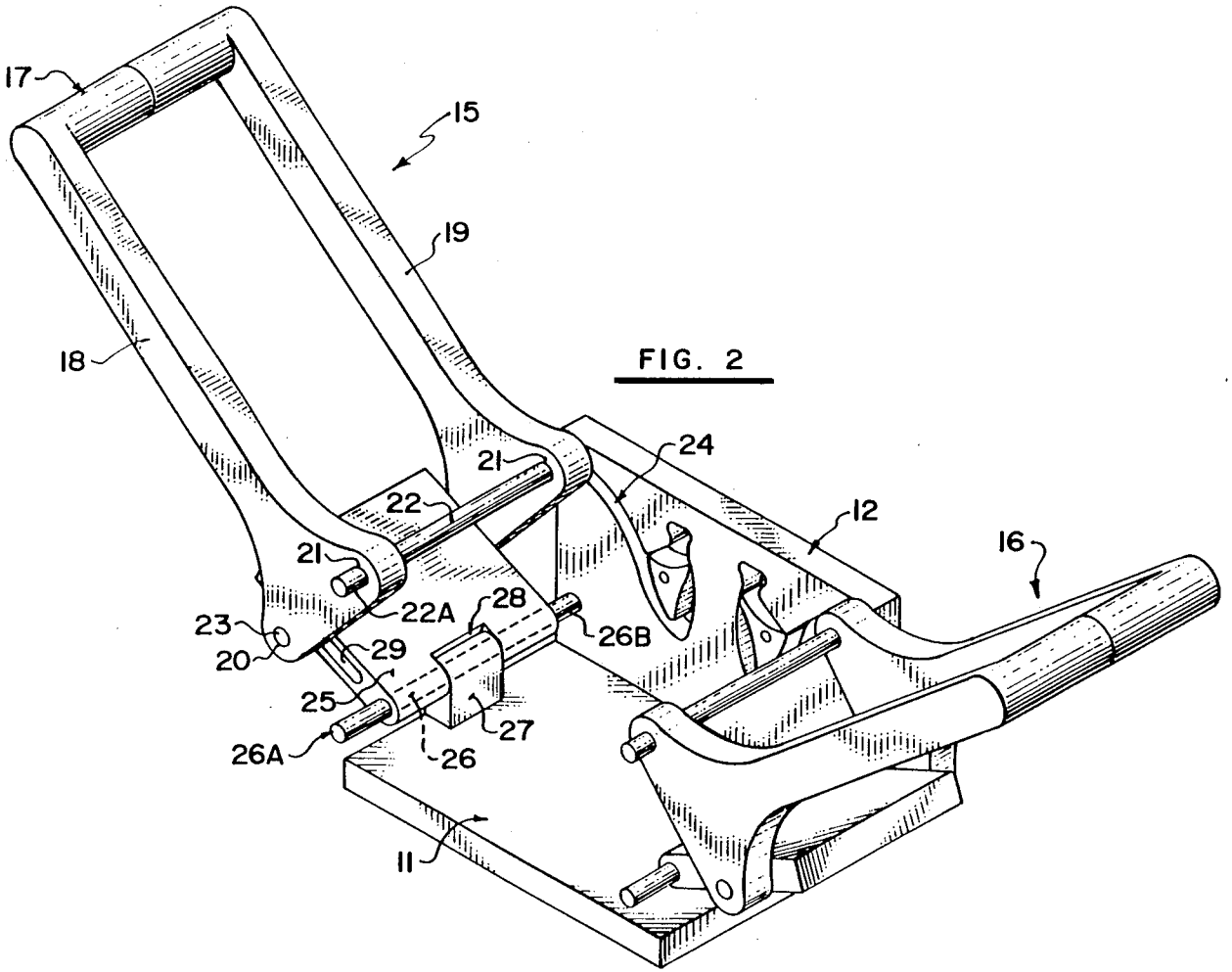
FIG. 2 is a similar view to that of FIG. 1 with one side wall of the base member removed to expose in more detail the crushing elements and levers.

In operation, the pin 22A is in the home position as shown in FIG. 2 in which the plate member 25 is pivoted outwardly away from the can receiving location of the base member and the rod 22 is raised upwardly from the can allowing it to be inserted into the receiving position between the bosses 27.

In a first portion of the crushing action, the lever mechanism is pivoted inwardly so that the pin 22A moves along the first portion of the cam-track downwardly to the bottom position 32. This causes the pin 22 to move downwardly onto the top of the can at a position just inwardly of the end of the can and then to commence crushing of the peripheral wall of the can downwardly towards the base wall 11. The rod acts in a sliding action across the peripheral wall to tend to fold the end of the can inwardly s the bottom edge of the end of the can remains adjacent the boss 27 but the top edge of the end of the can moves inwardly towards the other end of the can as it is pulled by the distortion of the peripheral wall.

When the rod 22 reaches the bottom position 32 of the cam-track, the first crushing action is complete and the rod 22 then begins to move upwardly as the pin 22A moves along the second path of the cam-track towards the upper position 34. The end of the initial crushing action is shown in the left hand side of FIG. 3. As the rod 22 moves substantially vertically, the weight of the hands of the user on the handle tends to move the handle outwardly in anti-clockwise direction as viewed from the left of FIG. 3. This outward movement tends to cause the plate member 25 to pivot inwardly about the rod 26 as caused by the cooperation between the rod 23 and the slot 29. This inward pivoting action brings the plate member 25 so that its crushing surface indicated 25A in FIG. 3 pivots around to contact the end of the can in its initially slightly folded position.

Figure 3:
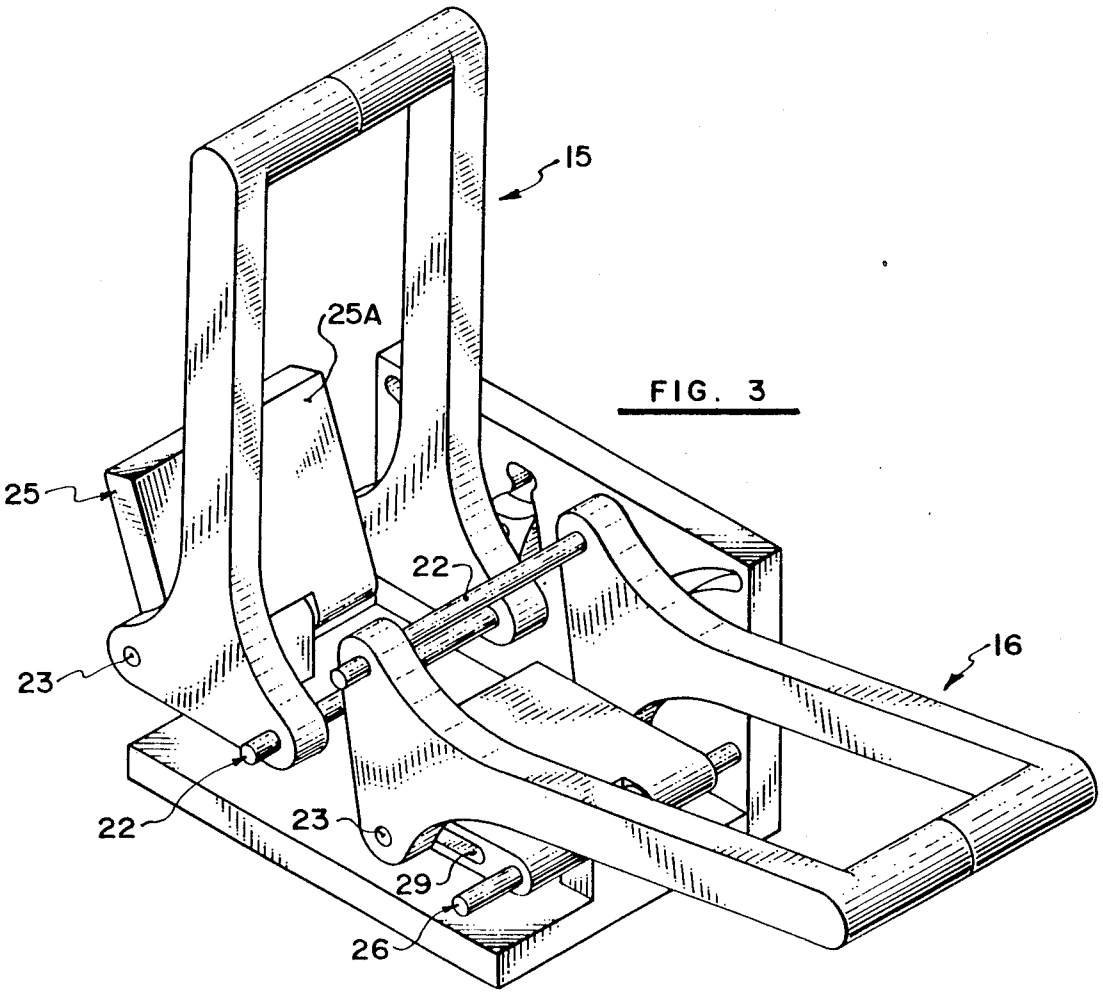
FIG. 3 is a similar isometric view to that of FIG. 1 but showing one lever and associated crushing elements in a first stage of the operation and the other lever and associated crushing element in a second stage of the crushing operation.

With the pin 22A in the upper position 34 of the cam-track, further downward movement of the handle causes the pin 22A to move into the right hand receptacle portion of the end 34 of the contract so the handle pivots about this fixed position of the pin 22A causing the rod 23 of the handle to be forced downwardly with the slot shaped opening 29 of the plate member 25 so that the plate member 25 is forced downwardly in a crushing action to take up the position shown in the right hand side of FIG. 3. It will be particularly noted from viewing FIG. 3 that the space in between the rod 22 and the rod 23 is such that with the rod 22 in the upper portion 34 of the cam-track, the rod 23 lies on the same horizontal plane as the rod 26 thus holding the plate member 25 in a horizontal position with the crushing surface 25A of the plate member parallel to the upper surface of the base wall 11 and spaced therefrom by a small distance of the order of ¼ to ½ inch.

The can is crushed by a first crushing action in which the side of the can is moved towards the base wall 11 with the ends of the can folding slightly inwardly following which the ends of the can are then continued in the folding direction to be crushed flat on top of the upper surface of the can. The undersurface of the can remains fully intact and is flattened so that the printed information is still visible for identification of the can.

The flattened cans are easy for transportation and a plastic carrying package can be provided which will accommodate 24 of the crushed cans with the cans being visible for identification of the can origin.

Since various modifications can be made in my invention as hereinabove described, and many apparently widely different embodiments of same made within the spirit and scope of the claims Without departing from such spirit and scope, it is intended that all matter contained in the accompanying specification shall be interpreted as illustrative only and not in a limiting sense.

We claim:

1. Apparatus for crushing a can which includes a cylindrical peripheral wall having a longitudinal axis and a pair of ends at right angles to the axis, the apparatus comprising a base member defining a surface against which the can is laid and is crushed, means defining an area on the base member for receiving the can with the axis of the can parallel to the surface, the ends of the can standing substantially outwardly at right angles from the surface, one side of the can being adjacent the surface and an opposed side of the can being rotates from the surface, first crushing means arranged to engage the peripheral wall at said opposed side of the can and to press the opposed side of the peripheral wall toward said one side such that the ends tend to partly fold inwardly toward the first crushing means, and second crushing means arranged to engage the ends of the can in the partly folded condition thereof and to compress the ends towards said surface of the base member, said first crushing means comprising a first and a second crushing member each extending transversely to the axis of the can and spaced apart axially of the base member so as to engage the can at a position thereon just inside a respective one of the ends thereof, limit means controlling movement of such crushing members so as to halt a crushing action of said first crushing means at a position spaced from the base member, and a first and a second lever device, each of said lever devices including a handle for manual movement thereof, each of said lever devices having a first crushing member forming one part of said first crushing mans and an end crushing member forming one part of said second crushing means, said first crushing member and said end crushing member being actuable by movement of said lever device.

2. The invention according to claim 1 wherein each of said end crushing members comprises a plate member having a substantially planar crushing surface dimensioned to overlie an end of the can, the plate member being pivotally mounted about an axis adjacent the base member surface for movement from a position engaging the partly folded end to a position in which the end is folded to lie substantially parallel to the base member surface.

3. The invention according to claim 1 wherein said lever device is substantially T-shaped in side elevation having said handle at a foot of the T-shape, said first crushing member being coupled to said lever device at one end of the cross bar of the T-shape and the end crushing member being coupled to the lever device at the other end of the cross bar of the T-shape.

4. The invention according to claim 3 wherein the first crushing member comprises a rod fixed on said lever device.

5. The invention according to claim 3 wherein the end crushing member comprises a plate member having a substantially flat crushing surface, one end of the plate member being pivotally coupled to the base member adjacent the surface of the base member and the other end of the plate member being pivotally coupled to the lever device.

6. The invention according to claim 5 wherein movement of the lever device is controlled by a cam-track provided in a side of the base member upstanding from said surface of the base member.

7. The invention according to claim 6 wherein the cam-track defines two paths arranged such that in a first of the paths the lever device is constrained to move the first crushing member in a crushing action, and a second of the paths the lever device is constrained to move the first crushing member away from the can and to move the end crushing member in a crushing action.

8. The invention according to claim 7 wherein the base member comprises a horizontal support wall and a pair of vertical side walls spaced on either side of the base member surface to define the area for receiving the can, the side walls each carrying said cam-track for guiding movement of a respective one of the lever devices.

9. The invention according to claim 7 wherein the cam-track includes a rotatable guide element for constraining movement sequentially of said lever device along said first, second and third paths.

10. Apparatus for crushing a can which includes a cylindrical peripheral wall having a longitudinal axis and a pair of ends at right angles to the axis, the apparatus comprising a base member defining a surface against which the can is laid and is crushed, means defining an area on the base member for receiving the can with the axis of the can parallel to the surface, the ends of the can standing substantially outwardly at right angles from the surface, one side of the can being adjacent the surface and an opposed side of the can being remote from the surface, a first and second crushing assembly separately mounted on the base member for movement relative thereto, each comprising first crushing means arranged to engage the peripheral wall at said opposed side of the can and to press the opposed side of the peripheral wall toward said one side such that the ends tend to partly fold inwardly toward the first crushing means, and second crushing means arranged to engage a respective end of the can in the partly folded condition thereof and to compress the end towards said surface of the base member, each of the first and second crushing assemblies comprising a lever device having a handle for manually actuated movement of the lever device, said first crushing means being mounted on said lever device for actuation thereby, said second crushing means comprising a plate member having a substantially flat crushing surface, the plate member being mounted on the base member for pivotal movement about a first axis adjacent the base member surface and transverse to the axis of the can for movement from a position engaging the partly folded each to a position in which the end is folded to lie substantially parallel to the base member surface, the lever device including means engaging the plate member and pivotal relative thereto about a second axis parallel to the first axis, the base member including at least one side member upstanding therefrom on a respective side of the base member surface, and guide means defined on the side member for controlling the pivotal movement of the lever device such that movement of said lever device actuates both said first crushing means and said plate member.

11. The invention according to claim 10 wherein said lever device has an upper end and a lower end, a handle at the upper end, said first crushing means being coupled to said lever device at the lower end and the plate member being coupled to the lever device at the lower end at a position spaced from the first crushing means.

12. The invention according to claim 11 wherein said guide means comprises a cam-track provided in said side member.

13. The invention according to claim 12 wherein the cam-track defines two paths arranged such that in a first of the paths the lever device is constrained to move the first crushing means in a crushing action, and a second of the paths the lever device is constrained to move the first crushing member away form the can and to move the plate member in a crushing action.

14. The invention according to claim 13 wherein the base member comprises a horizontal support wall and a pair of vertical side walls spaced on either side of the base member surface to define the area for receiving the can, the side walls each carrying said cam-track for guiding movement of a respective one of the lever devices.

15. The invention according to claim 12 wherein the first crushing means comprises a rod and wherein the rod projects into said cam-track.

16. The invention according to claim 10 wherein the first crushing means comprises a rod fixed on said lever device.

17. The invention according to claim 10 wherein the plate member includes a slot therein allowing longitudinal movement of the lower device relative thereto.

18. The invention according to claim 10 wherein the first crushing means each extend transversely to the axis of the cam and spaced apart axially of the base member so as to engage the can at a position thereon just inside the respective end of the can.

19. The invention according to claim 18 wherein there is provided limit means for controlling movement of the first crushing means so as to halt the crushing action thereof at a position spaced from the base member.

* * * * *